US006215242B1

(12) United States Patent
Janning

(10) Patent No.: US 6,215,242 B1
(45) Date of Patent: Apr. 10, 2001

(54) FIELD EMISSION DISPLAY DEVICE HAVING A PHOTON-GENERATED ELECTRON EMITTER

(75) Inventor: John L. Janning, Dayton, OH (US)

(73) Assignee: St. Clair Intellectual Property Consultants, Inc., Grosse Pointe, MI (US)

( * ) Notice: Subject to any disclaimer, the term of this patent is extended or adjusted under 35 U.S.C. 154(b) by 0 days.

(21) Appl. No.: 09/396,596

(22) Filed: Sep. 15, 1999

(51) Int. Cl.[7] ..... H01J 1/62

(52) U.S. Cl. ..... 313/495; 313/496; 313/422; 313/103 CM

(58) Field of Search ..... 313/495, 496, 313/497, 309, 336, 351, 105 CM, 103 R, 103 CM, 104, 422, 106, 107

(56) References Cited

U.S. PATENT DOCUMENTS 3,622,828 * 11/1971 Zinn ..... 313/495
5,012,153 * 4/1991 Atkinson et al. ..... 313/336
5,675,212 * 10/1997 Schmid et al. ..... 313/495
5,949,185 * 9/1999 Janning ..... 313/495

* cited by examiner

*Primary Examiner*—Nimeshkumar D. Patel
*Assistant Examiner*—Joseph Williams
(74) *Attorney, Agent, or Firm*—Harness, Dickey & Pierce, P.L.C.

(57) ABSTRACT

A cathodoluminescent field emission display device includes a faceplate through which emitted light is transmitted from an inside surface to an outside surface of the faceplate for viewing, a cathode electron emitter which provides a source of primary electron emissions for activating the display device, an anode of electrically conductive material disposed between the inside surface of the faceplate and the cathode emitter, and a light emitter layer of cathodoluminescent material disposed between the anode and the cathode emitter and capable of emitting light through the faceplate in response to bombardment by electrons emitted within the device. The cathode emitter is further defined as photosensitive material deposited onto a layer of transparent electrical conductive material. In operation, the photosensitive material generates electrons when exposed to light.

19 Claims, 2 Drawing Sheets

FIELD EMISSION DISPLAY DEVICE HAVING A PHOTON-GENERATED ELECTRON EMITTER

This invention relates to electronic field emission display devices, such as matrix-addressed monochrome and full color flat panel displays in which light is produced by using cold-cathode electron field emissions to excite cathodoluminescent material. Such devices use electric fields to induce electron emissions, as opposed to elevated temperatures or thermionic cathodes as used in cathode ray tubes.

BACKGROUND OF THE INVENTION

Cathode ray tube (CRT) designs have been the predominant display technology, to date, for purposes such as home television and desktop computing applications. CRTs have drawbacks such as excessive bulk and weight, fragility, power and voltage requirements, electromagnetic emissions, the need for implosion and X-ray protection, analog device characteristics, and an unsupported vacuum envelope that limits screen size. However, for many applications, including the two just mentioned, CRTs have present advantages in terms of superior color resolution, contrast and brightness, wide viewing angles, fast response times, and low cost of manufacturing.

To address the inherent drawbacks of CRTs, such as lack of portability, alternative flat panel display design technologies have been developed. These include liquid crystal displays (LCDs), both passive and active matrix, electroluminescent displays (ELDs), plasma display panels (PDPs), and vacuum fluorescent displays (VFDs). While such flat panel displays have inherently superior packaging, the CRT still has optical characteristics that are superior to most observers. Each of these flat panel display technologies has its unique set of advantages and disadvantages, as will be briefly described.

The passive matrix liquid crystal display (PM-LCD) was one of the first commercially viable flat panel technologies, and is characterized by a low manufacturing cost and good x-y addressability. Essentially, the PM-LCD is a spatially addressable light filter that selectively polarizes light to provide a viewable image. The light source may be reflected ambient light, which results in low brightness and poor color control, or back lighting can be used, resulting in higher manufacturing costs, added bulk, and higher power consumption. PM-LCDs generally have comparatively slow response times, narrow viewing angles, a restricted dynamic range for color and gray scales, and sensitivity to pressure and ambient temperatures. Another issue is operating efficiency, given that at least half of the source light is generally lost in the basic polarization process, even before any filtering takes place. When back lighting is provided, the display continuously uses power at the maximum rate while the display is on.

Active matrix liquid crystal displays (AM-LCDs) are currently the technology of choice for portable computing applications. AM-LCDs are characterized by having one or more transistors at each of the display's pixel locations to increase the dynamic range of color and gray scales at each addressable point, and to provide for faster response times and refresh rates. Otherwise, AM-LCDs generally have the same disadvantages as PM-LCDs. In addition, if any AM-LCD transistors fail, the associated display pixels become inoperative. Particularly in the case of larger high resolution AM-LCDs, yield problems contribute to a very high manufacturing cost.

AM-LCDs are currently in widespread use in laptop computers and camcorder and camera displays, not because of superior technology, but because alternative low cost, efficient and bright flat panel displays are not yet available. The back lighted color AM-LCD is only about 3 to 5% efficient. The real niche for LCDs lies in watches, calculators and reflective displays. It is by no means a low cost and efficient display when it comes to high brightness full color applications.

Electroluminescent displays (ELDs) differ from LCDs in that they are not light filters. Instead, they create light from the excitation of phosphor dots using an electric field typically provided in the form of an applied AC voltage. An ELD generally consists of a thin-film electroluminescent phosphor layer sandwiched between transparent dielectric layers and a matrix of row and column electrodes on a glass substrate. The voltage is applied across an addressed phosphor dot until the phosphor "breaks down" electrically and becomes conductive. The resulting "hot" electrons resulting from this breakdown current excite the phosphor into emitting light.

ELDs are well suited for military applications since they generally provide good brightness and contrast, a very wide viewing angle, and a low sensitivity to shock and ambient temperature variations. Drawbacks are that ELDs are highly capacitive, which limits response times and refresh rates, and that obtaining a high dynamic range in brightness and gray scales is fundamentally difficult. ELDs are also not very efficient, particularly in the blue light region, which requires rather high energy "hot" electrons for light emissions. In an ELD, electron energies can be controlled only by controlling the current that flows after the phosphor is excited. A full color ELD having adequate brightness would require a tailoring of electron energy distributions to match the different phosphor excitation states that exist, which is a concept that remains to be demonstrated.

Plasma display panels (PDPs) create light through the excitation of a gaseous medium such as neon sandwiched between two plates patterned with conductors for x-y addressability. As with ELDs, the only way to control excitation energies is by controlling the current that flows after the excitation medium breakdown. DC as well as AC voltages can be used to drive the displays, although AC driven PDPs exhibit better properties. The emitted light can be viewed directly, as is the case with the red-orange PDP family. If significant UV is emitted, it can be used to excite phosphors for a full color display in which a phosphor pattern is applied to the surface of one of the encapsulating plates. Because there is nothing to upwardly limit the size of a PDP, the technology is seen as promising for large screen television or HDTV applications. Drawbacks are that the minimum pixel size is limited in a PDP, given the minimum volume requirement of gas needed for sufficient brightness, and that the spatial resolution is limited based on the pixels being three-dimensional and their light output being omnidirectional. A limited dynamic range and "cross talk" between pixels are associated issues.

Vacuum fluorescent displays (VFDs), like CRTs, use cathodoluminescence, vacuum phosphors, and thermionic cathodes. Unlike CRTs, to emit electrons a VFD cathode comprises a series of hot wires, in effect a virtual large area cathode, as opposed to the single electron gun used in a CRT. Emitted electrons can be accelerated through, or repelled from, a series of x and y addressable grids stacked one on top of the other to create a three dimensional addressing scheme. Character-based VFDs are very inexpensive and widely used in radios, microwave ovens, and automotive dashboard instrumentation. These displays typically use low voltage ZnO phosphors that have significant output and acceptable efficiency using 10 volt excitation.

A drawback to such VFDs is that low voltage phosphors are under development but do not currently exist to provide the spectrum required for a full color display. The color vacuum phosphors developed for the high-voltage CRT market are sulfur based. When electrons strike these sulfur based phosphors, a small quantity of the phosphor decomposes, shortening the phosphor lifetimes and creating sulfur bearing gases that can poison the thermionic cathodes used in a VFD. Further, the VFD thermionic cathodes generally have emission current densities that are not sufficient for use in high brightness flat panel displays with high voltage phosphors. Another and more general drawback is that the entire electron source must be left on all the time while the display is activated, resulting in low power efficiencies particularly in large area VFDs.

Against this background, field emission displays (FEDs) potentially offer great promise as an alternative flat panel technology, with advantages which would include low cost of manufacturing as well as the superior optical characteristics generally associated with the traditional CRT technology. Like CRTs, FEDs are phosphor based and rely on cathodoluminescence as a principle of operation. High voltage sulfur based phosphors can be used, as well as low voltage phosphors when they become available.

Unlike CRTs, FEDs rely on electric field or voltage induced, rather than temperature induced, emissions to excite the phosphors by electron bombardment. To produce these emissions, FEDs have generally used a multiplicity of x-y addressable cold cathode emitters. There are a variety of designs such as point emitters (also called cone, microtip or "Spindt" emitters), wedge emitters, thin film amorphic diamond emitters or thin film edge emitters, in which requisite electric fields can be achieved at lower voltage levels.

Each FED emitter is typically a miniature electron gun of micron dimensions. When a sufficient voltage is applied between the emitter tip or edge and an adjacent gate, electrons are emitted from the emitter. The emitters are biased as cathodes within the device and emitted electrons are then accelerated to bombard a phosphor generally applied to an anode surface. Generally, the anode is a phosphor layer and a transparent electrically conductive layer applied to the inside surface of a faceplate, as in a CRT, although other designs have been reported. For example, phosphors have been applied to an insulative substrate adjacent the gate electrodes which form apertures encircling microtip emitter points. Emitted electrons move upwardly through the apertures and strike phosphor areas.

FEDs are generally energy efficient since they are electrostatic devices that require no heat or energy when they are off. When they operate, nearly all of the emitted electron energy is dissipated on phosphor bombardment and the creation of emitted unfiltered visible light. Both the number of exciting electrons (the current) and the exciting electron energy (the voltage) can be independently adjusted for maximum power and light output efficiency. FEDs have the further advantage of a highly nonlinear current-voltage field emission characteristic, which permits direct x-y addressability without the need of a transistor at each pixel. Also, each pixel can be operated by its own array of FED emitters activated in parallel to minimize electronic noise and provide redundancy, so that if one emitter fails the pixel still operates satisfactorily. Another advantage of FED structures is their inherently low emitter capacitance, allowing for fast response times and refresh rates. Field emitter arrays are in effect, instantaneous response, high spatial resolution, x-y addressable, area-distributed electron sources unlike those in other flat panel display designs.

While the FED technology holds out many promises, existing designs are not without drawbacks. For instance, due to the high vacuum requirements, field emission displays presently require spacers between the anode and cathode plates. In this way, the atmospheric pressure does not cause the plates to touch one another in the field emission device. A large number of spacers are needed to prevent the two plates from "bowing" or touching each other because the typical atmospheric pressure is approximately 14.7 pounds per square inch. These spacers are usually around 200 microns in height (0.008"). Structurally, such a height mandates a diameter of reasonable proportion.

Field emission displays also typically require high electric fields for electron generation from points as in the Spindt micro-tip cathode or high electric fields from surface type emitters having discontinuities. Spindt micro-tip electron emitters are acceptable for small displays but present fabrication problems as the size of the display increases. In the Spindt type cathode, multiple points are required for each pixel.

Extensive research and development has been devoted to FEDs in recent years, and yet these and other problems remain unsolved. It was against this background that the present invention has been conceived.

SUMMARY OF THE INVENTION

In accordance with the present invention, a cathode electron emitter may comprise a photosensitive material that generates electron emissions when exposed to light. Such an emitter may be used to provide a source of primary electron emissions in a field emission display device. The photosensitive material can preferably be deposited as a layer on top of a transparent electrical conductor material (e.g., ITO) which is deposited on a substrate. A tiny lamp or other light source can be used to direct light to the photosensitive material when electron emissions are desired. In accordance with one aspect of the invention, a near mono-molecular thin layer of magnesium oxide or other high secondary electron emission material may also be applied to the photosensitive material for enhanced electron emissions.

The above-mentioned and other objects, features and advantages of the invention will become apparent from the further descriptions and the attached drawings.

DETAILED DESCRIPTION OF THE PRESENTLY PREFERRED EMBODIMENTS

Figure 1:
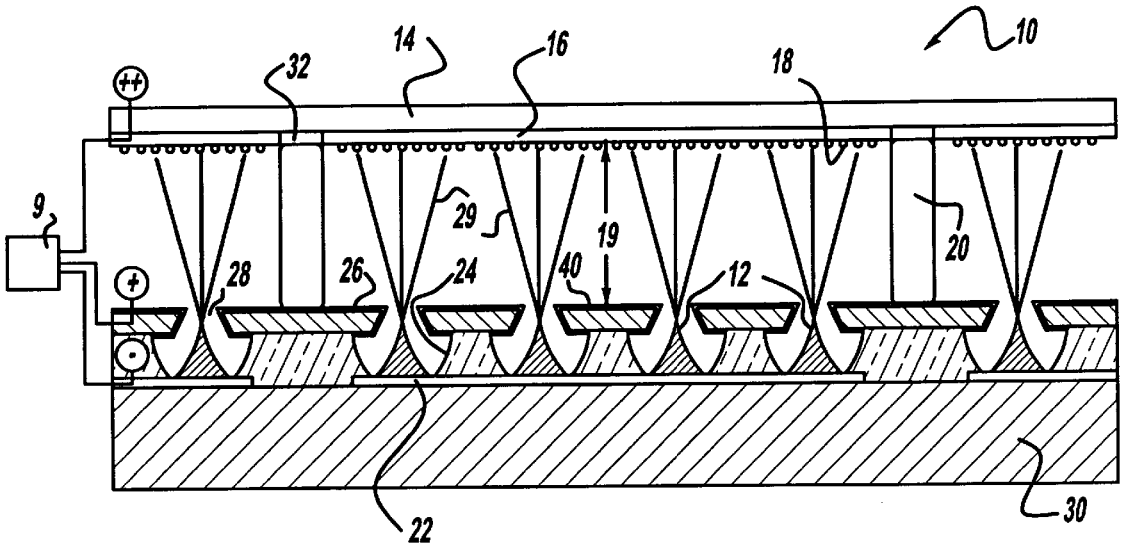
Figure - 1 Prior Art
FIG. 1 is a cross sectional schematic view of an exemplary field emission display device within the prior art.

FIG. 1 schematically depicts an exemplary field emission display (FED) device 10 found within the prior art. This flat panel display comprises an x-y electrically addressable matrix of cold-cathode microtip or "Spindt" type field emitters 12 opposing a faceplate 14 coated with a transparent conductor layer 16 and a phosphor light emissive layer 18. A distance or gap 19, generally on the order of 100 to 200 $\mu$m, may be maintained between the emitters 12 and the phosphors 18 by spacers 20. The volume of space between the emitters 12 and the phosphors 18 is typically evacuated to provide a vacuum environment with a pressure frequently in the range of $10^{-5}$ to $10^{-7}$ Torr. This environment is generally gettered (by means not illustrated) to mitigate against contamination of the internal parts, and to maintain the vacuum.

As illustrated, each emitter 12 has the shape of a cone and is coupled at its base to an addressable emitter electrode conductor strip or layer 22, through which the emitter 12 is biased as a cathode having a negative voltage, via power supply 9, with respect to the conductor 16 that serves as an anode. Adjacent conductor strips 22 can be electrically separated by extensions of a dielectric insulator structure 24 that also separates adjacent emitters 12. A conductive electron extraction grid 26 may be positively biased as a gate electrode with respect to the emitters 12, and has apertures 28 through which emitted electrons 29 have a path from the emitters 12 to the phosphors 18. The extraction grid 26 can comprise an addressable strip, orthogonal to the conductors 22, for servicing a row or column of matrix groups of emitters 12. In that case, there may be a multiplicity of orthogonal extraction grid strips and conductor strips used within the FED 10. As shown, the extraction grid 26 is spaced and electrically isolated from the conductors 22 by the insulator structure 24. The emitters 12 and the conductors 22 are formed on a substrate or base plate 30.

When the FED 10 is operational, a group of emitters 12 can be addressed and activated by application of a gate potential, usually on the order of about 15 to 50 volts, between the associated cathode electrode strip 22 and extraction grid 26. With a resulting primary field emission of electrons from the emitters 12, the emitted electrons may be accelerated toward the anode conductor layer 16 to bombard the intervening phosphors 18. The phosphors 18 may be induced into cathodoluminescence by the bombarding electrons, emitting light through the faceplate 14 for observation by a viewer. The operational potential between the cathode electrode strip 22 and the anode conductor layer 16 at the faceplate 14 is generally on the order of 500 to 1000 volts for FEDs using high-voltage, sulfur-based phosphors.

As illustrated in FIG. 1, the phosphors 18 may be optionally patterned on the faceplate 14 with conventional black matrix separations 32 to better define dots or discrete pixel areas that may be digitally addressed and illuminated on the FED 10. As shown, each pixel may be serviced by its own emitter or multiplicity of emitters 12 to provide redundancy in the event one or more of the emitters 12 prove inoperative.

By miniaturizing the size of the emitters 12, applied voltages can cause electrons to very efficiently emit out of the cone tips. For this reason, these and operationally similar field emitters are often called "cold cathode" emitters since they do not use thermionic emitter elements as do CRTs. "Spindt" type emitters 12 may be sized with cone heights on the order of about 1 $\mu$m, and pitched at about 10 microns or less, allowing packing densities on the order of about $10^6$ emitters per $cm^2$. Extraction grid apertures 28 are typically sized with diameters on the order of 1 $\mu$m.

The illustrated field emitter structure, comprising the emitters 12, the conductor strips 22, the insulator structure 24, and the extraction grid 26, can generally be made at low cost for small size displays using semiconductor microfabrication technology. For example, the emitters 12 can be formed on the conductor strips 22 on a silicon substrate 30 and overlaid by sequential depositions of a layer of silicon dioxide and a conductive metal gate film for the insulator structure 24 and the extraction grid 26. Resulting raised areas over the emitters 12 can be removed by polishing, and the silicon dioxide dielectric immediately surrounding the emitters 12 can be removed by wet chemical etching to define self-aligned apertures 28, as is well known. This process can present manufacturing problems as the display size increases.

FIG. 1 is not drawn to scale, as a typical FED of the type illustrated may have 100 or more of the emitters 12 for servicing of each pixel area on the display.

Figure 2:
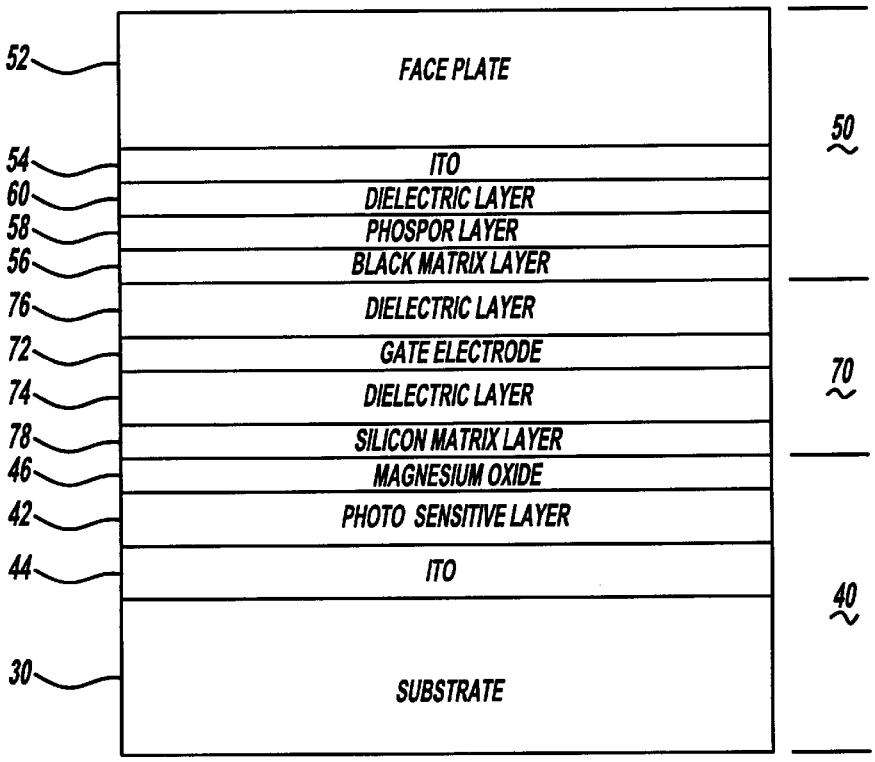
FIG. 2 is a cross sectional schematic view of an exemplary field emission display device implementing a cathode emitter comprised of photosensitive material in accordance with the present invention.

FIG. 2 schematically illustrates presently preferred embodiments of the invention with features which can be readily adapted to the type of FED device 10 shown in FIG. 1, as well as to other types of field emission display devices with other types of field emitters not illustrated. As shown in FIG. 2, a cathode emitter stage 40 can be comprised of a layer of photosensitive material 42 deposited onto a conditioned glass plate which serves as the substrate 30. A thin transparent electrical conductor 44, such as indium-tin-oxide (ITO), is also disposed (preferably at less than 300 Ohms/square) between the photosensitive material layer 42 and the substrate 30. The photosensitive material is preferably cesium oxide, rubidium oxide or some other alkali compound that is deposited to a thickness on the order of 500 Angstroms. The glass plate is preferably conditioned so that light is diffused across the plate, thereby impinging upon the photosensitive material. Some useful conditioned glass plates might be milk glass, sandblasted or etched glass plates through which light may be diffused in transmission. As will be apparent to one skilled in the art lighting, such as edge-lighting or back-lighting, may be used to activate the photosensitive material. While a single emitter is schematically illustrated for servicing of a single display pixel location, it will be understood that a matrix or multiplicity of cathode emitters may be used, such as was previously described with reference to FIG. 1.

A conventional anode structure can be used within an FED device having a photosensitive emitter. For example, the display device can incorporate an anode stage 50 comprised of a faceplate 52 coated with a transparent conductor layer 54 (e.g., indium tin oxide) and a light emissive layer 58. Preferably, an optional thin dielectric layer 60 (e.g., silicon nitride) of approximately 30–40 Angstroms in thickness can be disposed between the transparent conductor layer 54 and the light emissive layer 58.

In addition, an optional blocking element, such as a black matrix layer 56, can be incorporated to prevent light feedback to the light sensitive cathode emitter as shown in FIG. 2. The black matrix layer 56 may be appropriate if the phosphor light output frequency is one that would cause such feedback. On the other hand, if an infrared light source is used as the initiator such that the photosensitive material is only sensitive to infrared light, then the black matrix layer 56 may not be as useful in the display device. The black matrix layer 56 is preferably a photo-patternable material such as black chrome, opaque polyimide or black carbon frit. The black matrix layer 56 may be deposited to a thickness on the order of 200 Angstroms between the light emissive layer 58 and the dielectric layer 76.

Light emissions from the light emissive layer 58 can be gated such as by aid of an intermediary stage 70 positioned between the cathode emitter stage 40 and the anode stage 50.

Figure 3:
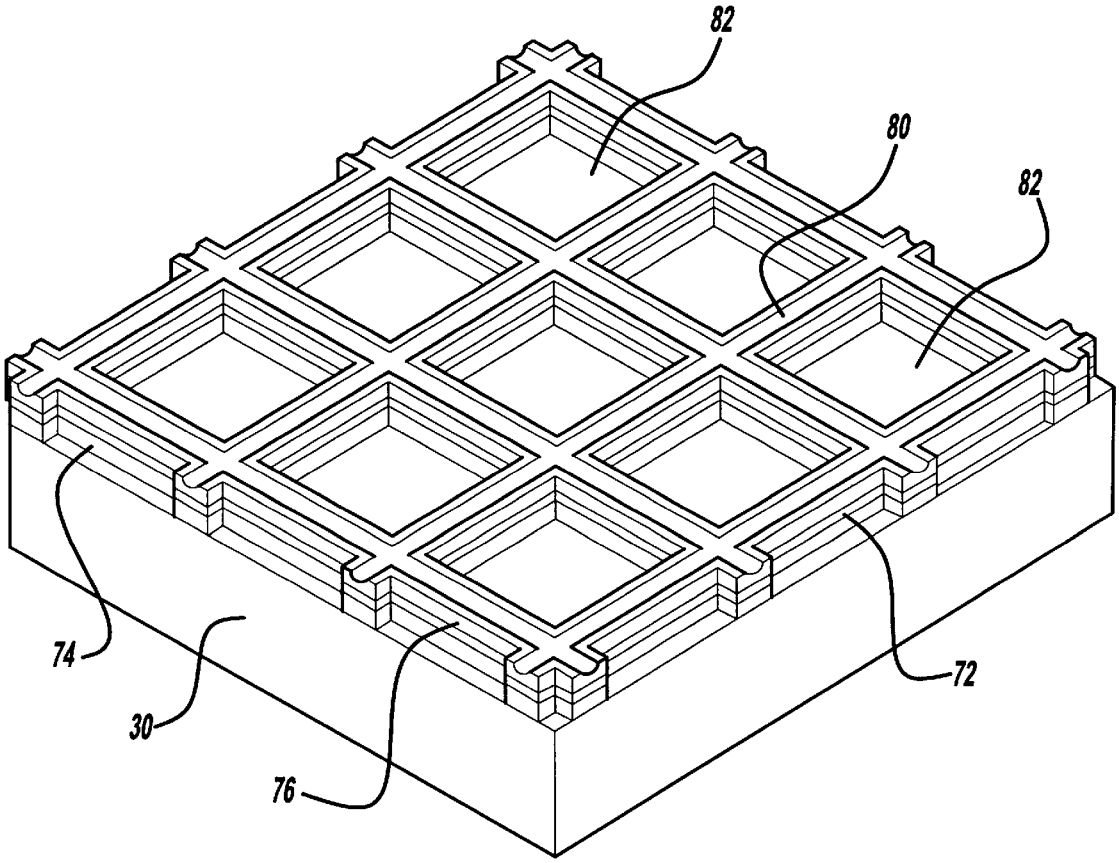
FIG. 3 is a perspective view of an exemplary cathode and intermediary stage of the field emission display device of the present invention.

Although the intermediary stage 70 can be built onto either of these two stages, it is shown built onto the cathode emitter stage 40. The intermediary stage 70 is preferably comprised of a gate electrode layer 72 sandwiched between two dielectric layers 74 and 76. Referring to FIGS. 2 and 3, a first dielectric layer 74 (e.g., silicon dioxide or silicon nitride) having a thickness on the order of 7500 Angstroms can be deposited over the cathode stage 40. Next, a conductor film (e.g., tungsten molybdenum or other refractory metal) that serves as the gate electrode layer 72 can be deposited over the first dielectric layer 74. The gate electrode layer 72 is preferably deposited to a thickness on the order of 2000 Angstroms. Another dielectric layer 76 preferably on the order of 7500 Angstroms can then be deposited over the gate electrode layer 72. The second dielectric layer may optionally have grooves 80 etched therein so that in a vacuum environment the pressure can equalize in all of the cavities throughout the display device.

After each of the layers forming the intermediary stage are deposited as described onto the cathode emitter stage 40, cavities 82 for each pixel can be formed into the intermediary stage 70 as shown in FIG. 3. In order to delineate and form the cavities 82, a pattern of photoresist material can be applied to the top surface of the intermediary stage 70 and then delineated using well known photolithography techniques. For instance, the layers may be etched anisotropically by conventional plasma etching techniques.

Optionally, a thin silicon nitride film 78 can be disposed between the first dielectric layer 74 and the cathode stage 40. This thin silicon nitride film is preferably deposited to a thickness on the order of 25 Angstroms. When ethcing to form cavities 82, the gas species in the etching system is monitored throughout the etching process until the silicon nitride is detected. At this point, a cavity should have been formed through the intermediary stage 70 to the top surface of the cathode emitter stage 40 and thus the etching process is complete. It is also envisioned that other materials may be used in place of the silicon nitride. For instance, if silicon nitride is used for the first dielectric layer 74, then silicon oxide may be used for the optional film 78. In this case, the etching process occurs until silicon oxide is detected. One skilled in the art will recognize that other dielectric material combinations may be used for constructing the intermediary stage 70.

To complete construction of the display device, the stages are then sealed in a vacuum and assembled together using other well known sealing and evacuating techniques. The entire thickness of the field emission display device in accordance with the present invention can be on the order of one-tenth of one-thousandths of an inch (i.e., on the order of two and one-half microns thick, excluding the thickness of the substrate). Due to the small spacing between cathode stage 40 and anode stage 50, a very high electric field can be obtained using reasonable operating voltages. However, a high internal vacuum may not be required for the display device. For instance, the spacing could be evacuated to a pressure on the order of $10^{-5}$ Torr. The vacuum is maintained by well known gettering techniques.

In operation, when a voltage is applied between the cathode (negative) and the anode (positive), there may be little, if any, current flowing within the display device. However, when light is made to fall upon the cathode emitter stage 40, electrons are emitted from the photosensitive layer 42. Since the anode is positively biased with respect to the cathode, the electrons tend to be directed toward the anode. The emitted electrons may then pass through the cavities 82 formed in the intermediary stage 70. In order to facilitate passage of electrons through the cavities 82 from the cathode to the anode, a small positive charge may optionally be applied to the gate electron layer 72. On the other hand, if a negative charge of sufficient magnitude is placed on the gate electrode layer 72, electrons can be repelled and prevented from reaching the anode. In this way, an applied voltage to the gate electrode layer 72 can be switched from negative to positive with respect to the cathode emitter as a way of gating or selective activating and deactivating the phosphor pixel areas within the display device. Display pixel elements can thus be turned on or off and the brightness or gray scale of emitted light can be controlled by the gate electrode.

By depositing a very thin film of magnesium oxide 46 (approximately 15–20 Angstroms) over the photosensitive layer 42, electrons may be 'pushed off' the magnesium oxide in such a manner as to permit continued emission from the cathode emitter. It is known that when heated and subject to a high electric field that thin magnesium oxide films can emit electrons. Moreover, so long as an electric field is applied, the magnesium oxide film may continue emitting electrons. As applied to the operation of this embodiment, the initial emission of electrons can be started from the cathode by a light source placed either behind the cathode plate or edge lighted while the display is under a high electric field. The presence of magnesium oxide on the cathode emitter provides an alternative means of fabricating the display cavities in the intermediary stage 70. In this case it would be the detection of magnesium in the gas species that would preferably serve as the indicator to terminate the etching process. One skilled in the art will readily recognize that other secondary electron emissive materials may be substituted for magnesium oxide in the present invention.

While the presently preferred embodiments of the invention have been illustrated and described, it will be understood that those and yet other embodiments may be within the scope of the following claims.

What is claimed is:

1. A cathodoluminescent field emission display device, which comprises:

a faceplate through which emitted light is transmitted from an inside surface to an outside surface of the faceplate for viewing;

a cathode electron emitter, comprising a photosensitive material which provides a source of primary electron emissions for activating the display device;

an anode, comprising a layer of electrically conductive material disposed between the inside surface of the faceplate and the cathode emitter;

a light emitter layer of cathodoluminescent material capable of emitting light through the faceplate in response to bombardment by electrons emitted within the device, disposed between the anode and the cathode emitter; and a dielectric layer disposed between the anode and the light emitter layer.

2. The field emission display device of claim 1 wherein said photosensitive material comprises an alkali compound.

3. The field emission display device of claim 1 wherein said photosensitive material comprises material selected from the group comprising cesium oxide and rubidium oxide.

4. The field emission display device of claim 1 wherein said cathode emitter is disposed on a substrate, where the substrate is a glass plate.

5. The field emission display device of claim 4 further comprises a light source for transmitting light to the photosensitive material through an exposed edge of said substrate.

6. The field emission display device of claim 4 further including a light source for transmitting light to the photosensitive material when said substrate is backlighted.

7. The field emission display device of claim 4 further comprising a transparent electrical conductor layer disposed between the photosensitive material and the substrate.

8. The field emission display device of claim 1 further comprises a secondary electron emissive material disposed on said photosensitive material.

9. The field emission display device of claim 8 wherein said secondary electron emissive material further comprises a magnesium oxide layer deposited on the order of 20 Angstrom thick.

10. The field emission display device of claim 1 wherein the dielectric layer is on the order of 40 Angstroms thick.

11. The field emission display device of claim 1 further comprises a light blocking element disposed between the light emitting layer and the cathode emitter for preventing light feedback to the cathode emitter.

12. The field emission display device of claim 11 wherein said light blocking element is further defined as a black matrix layer, said black matrix layer comprises material selected from the group comprising black chrome, opaque polyimide, and black carbon frit.

13. The field emission display device of claim 12 wherein said black matrix layer comprises a layer on the order of 200 Angstroms thick.

14. The field emission display device of claim 1 further comprises an intermediary gating layer disposed between the light emitting layer and the cathode emitter, said intermediary gating layer includes a gate electrode layer disposed between at least two dielectric layers.

15. The field emission display device of claim 14 wherein said gate electrode layer comprises a conductive material.

16. The field emission display device of claim 14 wherein said gate electrode layer comprises tungsten.

17. The field emission display device of claim 14 wherein said gate electrode layer deposited to a thickness on the order of 2000 Angstroms.

18. The field emission display device of claim 14 wherein each of said dielectric layers comprises materials selected from the group comprising silicon dioxide and silicon nitride.

19. The field emission display device of claim 16 wherein each of said dielectric layers deposited to a thickness on the order of 7500 Angstroms.

* * * * *